United States Patent [19]

Stromberg

[11] 3,991,670

[45] Nov. 16, 1976

[54] APPARATUS FOR BALING FIBROUS MATERIAL

[75] Inventor: Nils-Erik Strömberg, Sundsvall, Sweden

[73] Assignee: Sunds Aktiebolag, Sundsvall, Sweden

[22] Filed: June 19, 1975

[21] Appl. No.: 588,342

Related U.S. Application Data

[63] Continuation of Ser. No. 348,692, April 6, 1973, abandoned.

[30] Foreign Application Priority Data

Apr. 25, 1972 Sweden ..... 5399/72

[52] U.S. Cl. ..... 100/295; 100/3; 206/83.5

[51] Int. Cl.[2] ..... B30B 15/06

[58] Field of Search ..... 100/1, 2, 3, 35, 295; 206/83.5; 53/124 D

[56] References Cited

UNITED STATES PATENTS 206,658 8/1878 Blossom ..... 100/295

3,063,363 11/1962 Lamb ..... 100/295

FOREIGN PATENTS OR APPLICATIONS 398,144 9/1933 United Kingdom

*Primary Examiner*—Billy J. Wilhite

*Attorney, Agent, or Firm*—Pierce, Scheffler & Parker

[57] ABSTRACT

In a pressing apparatus for compressing a mass of fibrous material, such as cellulose pulp, into a bale and wrapping the resulting bale with wire or strip, there is used a bale press stand, a stationary first press plate and a second press plate movable toward and away from said press plate, together with means for moving said second press plate. The second press plate has a pressure-applying face constituted by a planar border surface normal to the direction of movement of said second press plate and a centrally disposed portion projecting 10–50 mm. from the plane of said border surface, for effecting a permanent depression, centrally in an end surface of a bale formed in said apparatus, facilitating the gripping and lifting of a wire or strip which is wrapped around a number of such bales.

1 Claim, 12 Drawing Figures

FIG.1
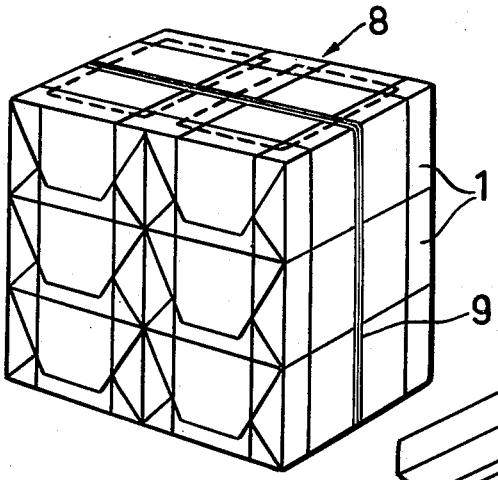
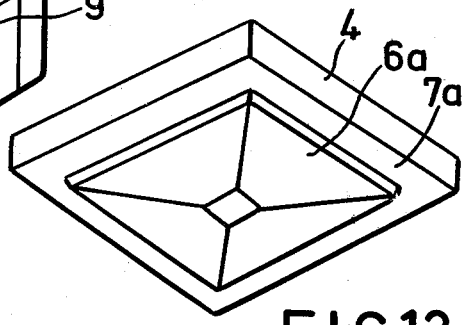
FIG.12
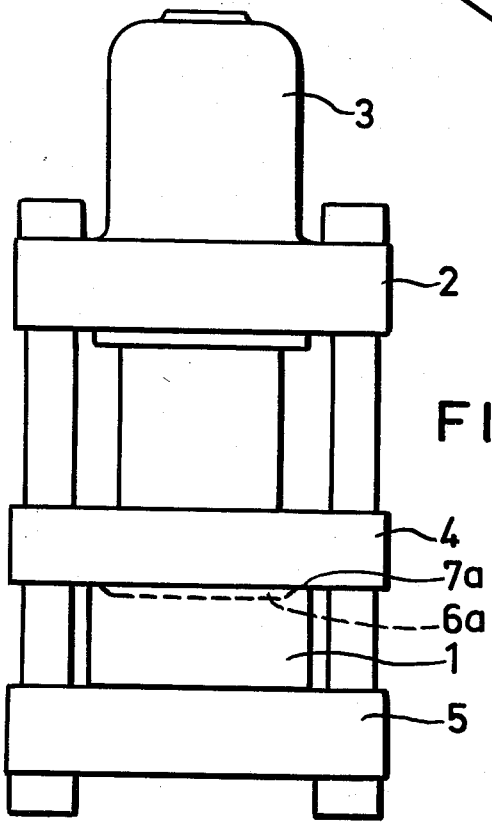
FIG.2

APPARATUS FOR BALING FIBROUS MATERIAL

This is a continuation of application Ser. No. 348,692 filed Apr. 6, 1973, now abandoned.

Fibrous material such as, for example, cellulose pulp produced in the form of sheets or in a loosened-up, i.e. finely distributed and dried state, for example in so-called flock-dried state, is for its storage and transport pressed to bales and packed, if necessary with protective wrapping. In order to facilitate the transportation, several bales are usually collected to one unit load and wrapped around with strips or wires. Different types of lifting means are applied for handling the unit loads, depending on the form and location of the strips or wires. For the handling of cellulose pulp, usually six or eight bales are collected to one unit load, which has a weight of between one and two tons.

At one conventional system, the bales pressed and collected to a unit load are held together by a steel strip extending around the load and locked by a strip locking means. For rendering possible lifting of the unit load, on said first strip extending around the load a second strip is welded on both sides of the large-size bundle close to its upper surface. Said second strip extends loosely over the large-size bundle, so that the gripping members of the lifting means can be inserted below the strip. The lifting means usually is provided with magnets, which at first lift the loose strip and thereby facilitate insertion of the gripping members.

According to this system, thus, the unit load can be automatically gripped and lifted. This is an advantage from a safety point of view particularly at the discharge of unit loads from cargo spaces on ships, because no man is required to be in the cargo space whilst the discharge operation is going on. The system, however, includes also a great number of shortcomings. The areas at the weldings, for example, where the loose strip is secured on the strip extending around the load, are weak points. These areas are subjected to specially high stresses when the strip extending around the load is not placed centrally, i.e. when the centre of gravity of the unit load is located to the side of the winding plane or when the bundle is to be drawn in lateral direction. At such occasions the strips easily break. When several unit loads are stacked one upon the other, the loose strip, of course, is clamped between the unit loads so that it may be buckled and loose part of its strength. This bundling system, moreover, is relatively expensive owing to the high costs of specially made strips and strip lockings.

At another system wires are used instead of strips. Several such wires are required for obtaining sufficient strength. For rendering possible lifting, two edge pieces are placed on opposed upper edges of the unit load and fastened by means of the bundling wires wound over the edge pieces. Said edge pieces are formed with lifting eyes.

This system eliminates to a large extent the shortcomings of the system using strips. However, the lifting member cannot automatically catch the unit load, because the lifting eyes in the edge pieces are much too small. A man, therefore, has to be present at the unit load for hooking the lifting member into the load.

The present invention has as its object to eliminate the disadvantages of the conventional systems and at the same time to provide further advantages.

The problem of lifting the unit loads in a simple and safe manner is solved by the present invention in principle already in the bale press proper. The upper press plate of the bale press is provided with a central projecting portion, which at the pressing operation brings about a corresponding depression in the bales. After their pressing the bales are wrapped in usual manner by wires laid around the bales and secured by knots on the lower side of the bales. Thereafter a plurality of bales, usually six or eight, are collected to one unit load, which is wrapped with a plurality of wires located adjacent each other. Also strips may be used, but wires are to be preferred, primarily for economic reasons. The number of wires depends on the weight of the unit load, the wire dimension and required safety factor. A suitable wire dimension is 2–3 mm, in which case four to six wires are required. The depression in the upper surface of the bales renders it possible to insert gripping members of the lifting means between the uppermost bales in the unit load and the bundling wires. The gripping member preferably is designed as a pair of well-rounded grapples, each from one direction engaging below the wires. The grapples having been closed in this way, the two grapple pairs are moved outward to the edges of the unit load and thereby provide increased stability at the lifting operation.

The depression in the upper surface of the bales must have such a depth and such an extension that the gripping member can comfortably and safely be inserted beneath the bundling wires. In consideration of the pressing operation and of the bearing capacity of the edge zone of the bales which is not depressed, however, the depression must not be given too large dimensions. The depth should be in the range of 10 to 50 mm, suitably 12 to 25 mm and preferably 15 to 20 mm while the edge zone should have a width of 25 to 200 mm, suitably 30 to 100 mm and preferably 50 to 75 mm. A bale of cellulose pulp usually has a height of about 500 mm, a width of about 600 mm and a length of about 800 (900) mm. The edge zone may extend along two opposed sides of the bales, but preferably it extends about the entire upper side of the bales.

As the cellulose material has a tendency of swelling after its pressing, it may be suitable to form the projection of the upper press plate so that it is somewhat higher at the centre than at the edges. The difference may preferably be 10 to 15 mm in order to provide a relatively plane depression in the bale after its swelling. The upper surface of the projection which faces the bale may, for example, have a uniform curvature or pyramid shape, possibly with a plane top.

The depression in the upper surfaces of the bales not only renders possible direct lifting at the bundling wires, but it shows advantages also at the assembly of bales to one unit load. The edge zones of the bales constitute a support surface for bales placed thereabove and thereby provide a very good stacking stability. Besides, the knots of the wrapping wires on the bale which are located on the lower bale side, will come to lie in the depression of the bale below so that there is less risk that the knots may damage the wrapping paper of the bales.

Referring to the drawings,

FIG. 1 shows a unit load comprising six bales,

FIG. 2 shows a bale press according to the invention,

FIG. 12 shows a suitable design of a press plate provided with the projecting portion.

Figure 3:
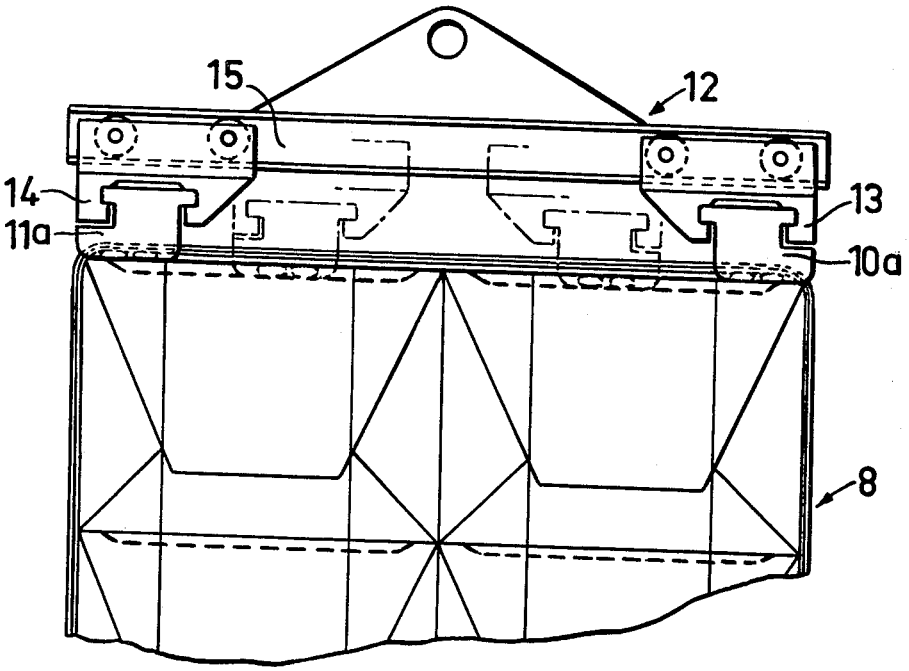
FIG. 3 shows the upper portion of a unit load lifted by a lifting means.
Figure 4:
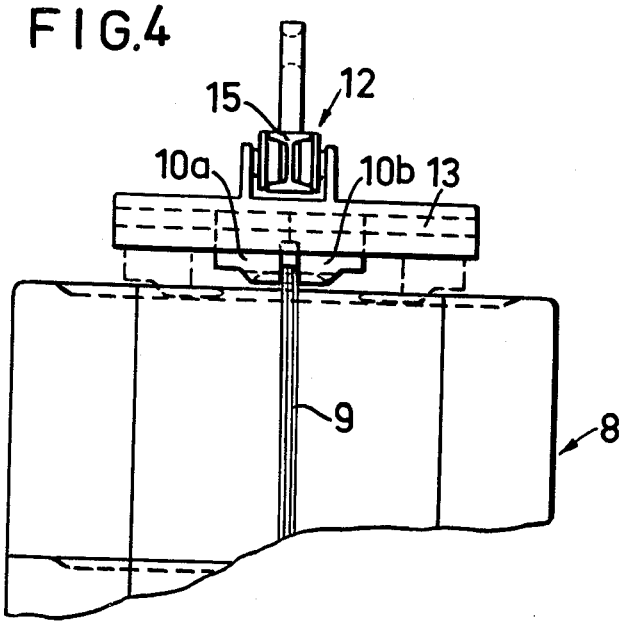
FIG. 4 shows the unit load and the lifting means seen from the side.
Figure 5:
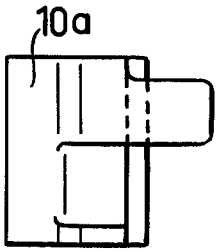
FIGS. 5 – 11 show the design and function of the gripping members.
Figure 9:
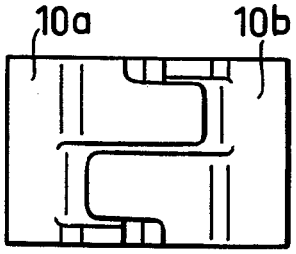
Figure 7:
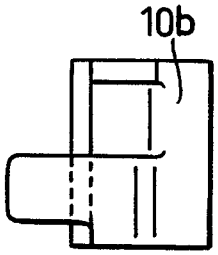
Figure 6:
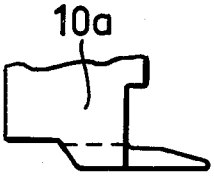
Figure 10:
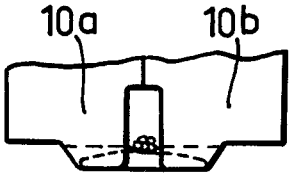
Figure 8:
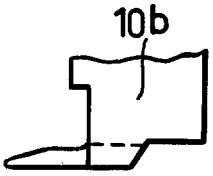

The invention is described in greater detail in the following, with reference to the Figures. At the handling of cellulose pulp according to the invention in the form of sheets or in loosened-up or finely distributed state, the pulp first is formed to bales 1 in a bale press, which comprises a stand 2 and an upper and a lower press plate 4 and, respectively, 5. The upper press plate 4 is movable by means of a hydraulic cylinder 3 and formed with a central projecting portion 6*a*, which is limited by a plane edge zone 7*a*. The transition between the edge zone and projecting portion is rounded or beveled. The upper surface of the projecting portion facing the bale preferably has pyramid shape with a small plane surface in the centre, see FIG. 12. The object of this extra bulging of the projecting portion is to compensate for the swelling of the bale subsequent to its pressing.

At the pressing operation, each bale is provided with a depression 6*b* in the upper surface which corresponds to the projecting portion 6*a* of the press plate, and with an edge zone 7*b* limiting said depression and corresponding to the edge zone 7*a* of the press plate.

Subsequent to the pressing operation each bale is wrapped individually in usual manner. Thereafter six to eight bales are assembled to a unit load 8, which is held together by wires 9. A space is formed thereby between the wires and the bottom of the depression 6*b* in the upper surfaces of the two uppermost bales. This space can be utilized at the lifting of the unit load in such a manner, that grapples 10*a*, *b* and, respectively, 11*a*, *b* on a lifting means 12 can be inserted in said space. The wrapping paper of the bales does not obstruct this insertion as it can be easily pressed down into the depression by the grapples.

Figure 11:
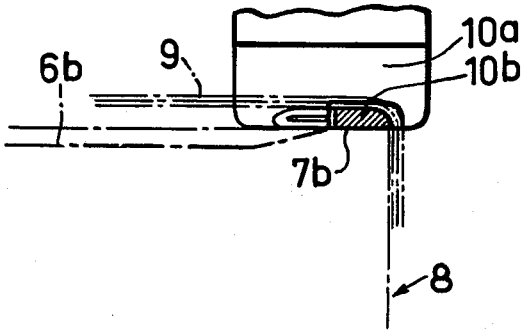

At the lifting of the unit load first the lifting means 12 is lowered over the unit load whereafter the grapples 10*a*, *b* and, respectively, 11*a*, *b* in pairs engage with each other beneath the wires 9. In FIGS. 5 – 10 are shown a pair of coacting grapples 10*a*, *b*, seen partly from below and partly from the sides. Each pair of grapples are movable to and from each other in grooves 13, 14 in the lifting means 12. In order to provide the desired stability at the lifting operation, the two pairs of grapples 10*a*, *b* and, respectively, 11*a*, *b* are moved apart along a bar 15 on the lifting means to the edge of the unit load. This position is shown in FIGS. 3 and 11. Thereafter the unit load can be lifted.

The invention, of course, is not restricted to the embodiment shown and described, but may be varied within the scope of the claims.

I claim:

1. In an apparatus for pressing fibrous material into a bale for subsequent wrapping with wire or strip, comprising a bale press stand, with an upper and a lower press plate and means for moving the upper press plate toward and away from the lower press plate, the improvement according to which the pressure-applying face of said upper press plate is constituted by a planar border surface normal to the direction of pressing movement of said plate and a centrally located projecting portion, said projection having a height of from 10 to 50 mm., for effecting a permanent depression centrally in the top surface of a bale in order to facilitate the gripping and lifting of a wire or strip which is wrapped around a number of such bales.

* * * * *